US007056876B2

(12) United States Patent
Shamayeli

(10) Patent No.: US 7,056,876 B2
(45) Date of Patent: Jun. 6, 2006

(54) ALKALINE, HYDROUS PASTE

(75) Inventor: Khalil Shamayeli, Dusseldorf (DE)

(73) Assignee: Ecolab Inc., St. Paul, MN (US)

( * ) Notice: Subject to any disclaimer, the term of this patent is extended or adjusted under 35 U.S.C. 154(b) by 464 days.

(21) Appl. No.: 10/450,027

(22) PCT Filed: Nov. 29, 2001

(86) PCT No.: PCT/EP01/13961

§ 371 (c)(1),
(2), (4) Date: Jul. 28, 2003

(87) PCT Pub. No.: WO02/46351

PCT Pub. Date: Jun. 13, 2002

(65) Prior Publication Data

US 2005/0227899 A1 Oct. 13, 2005

(30) Foreign Application Priority Data

Dec. 9, 2000 (DE) ..... 100 61 416

(51) Int. Cl.
*C11D 1/72* (2006.01)
*C11D 3/10* (2006.01)
*C11D 7/06* (2006.01)
*C11D 17/00* (2006.01)

(52) U.S. Cl. ..... 510/404; 510/221; 510/339; 510/356; 510/360; 510/421; 510/475

(58) Field of Classification Search ..... 510/221, 510/339, 356, 360, 404, 421, 475
See application file for complete search history.

(56) References Cited

U.S. PATENT DOCUMENTS

| | | | | |
|---|---|---|---|---|
| 5,691,292 | A | 11/1997 | Marshall et al. | |
| 5,929,014 | A * | 7/1999 | Beaujean et al. | 510/336 |
| 5,981,457 | A | 11/1999 | Ahmed | |
| 6,627,592 | B1 * | 9/2003 | Shamayeli et al. | 510/303 |

FOREIGN PATENT DOCUMENTS

| | | |
|---|---|---|
| DE | 19726287 | 12/1998 |
| DE | 19828578 | 12/1999 |
| DE | 19857687 | 6/2000 |
| EP | 0295525 | 12/1988 |
| EP | 0953631 | 11/1999 |
| GB | 2193505 | 2/1988 |
| WO | WO9509229 | 4/1995 |
| WO | WO9810049 | 3/1998 |
| WO | WO0066696 | 11/2000 |

* cited by examiner

*Primary Examiner*—Brian P. Mruk
(74) *Attorney, Agent, or Firm*—Andrew D. Sorensen; Anneliese M. Selfert

(57) ABSTRACT

Hydrous, paste-like, thixotropic detergent or cleaning agent containing, based on the whole agent,
a) an alkalinity support, selected from alkali hydroxide and/or alkali carbonate, in a quantity of 5 to 40 wt. %, preferably 8 to 30 wt. %,
b) at least 5 wt. %, preferably 15 to 40 wt. % water, and
c) more than 3 wt. %, preferably 5.5 to 30 wt. %, particularly preferably 6 to 15 wt. % non-ionic surfactants,
wherein, at 25° C., the agent has a viscosity of 50,000 mPas to 250,000 mPas, measured using a Brookfield rotational viscometer (spindle no. 7) at 5 revolutions per minute and, under otherwise identical conditions, at 50 revolutions per minute has a viscosity of 12,000 mPas to 80,000 mPas.

24 Claims, No Drawings

ALKALINE, HYDROUS PASTE

The present invention relates to paste-like thixotropic detergents or cleaning agents containing substantial proportions of alkalinity supports, non-ionic surfactants and water, and to washing processes in which such agents are used. In addition, the invention relates to washing processes of the kind in which the waste water or a part of the detergent solution is treated by membrane technology.

European Patent EP 295 525 B1 discloses paste-like detergents consisting of a phase which is liquid within the temperature range below 10° C. and is formed from non-ionic surfactant and, dispersed therein, a solid phase having a specific particle size which is formed from detergent alkalies, sequestering agents and optionally anionic surfactants. It is a requirement that surfactants or mixtures thereof having a setting point (solidification point) which must lie below 5° C. be used, in order to avoid solidification of the paste at low transport temperatures and storage temperatures. This detergent paste is intended for commercial laundries and is flowable to the extent that it can be delivered through a suction pipe by means of a conventional feed pump. It has been found, however, that during the production of such pastes the homogeneity of their constituents cannot be satisfactorily guaranteed and during storage the pastes frequently tend to separate. This separation involves not only the separation of the solid from the liquid constituents, but also the phase separation of the liquid constituents.

Another paste-like detergent, containing as non-ionic surfactant 40 to 70 wt. % ethoxylated fatty alcohol which has 10 to 20 carbon atoms and an average degree of ethoxylation of 1 to 8 and is liquid at room temperature, as well as 20 to 50 wt. % ethoxylated and propoxylated fatty alcohol which has 10 to 20 carbon atoms and an average degree of ethoxylation of 2 to 8 and an average degree of propoxylation of 1 to 6 and is liquid at room temperature, as well as 1 to 10 wt. % soap, is described in International Patent Application WO 95/09229. This paste-like detergent or cleaning agent is so structurally viscous that at room temperature it is not flowable under the action of gravity, but under shearing exhibits a distinctly lower viscosity and is then flowable under the action of gravity. The metering of this paste-like detergent or cleaning agent is carried out preferably by subjecting the agent to shearing in order to lower the viscosity and the subsequently flowable agent can then be metered by means of feed pumps.

International Patent Application WO 98/10049 discloses a paste-like detergent for use in commercial laundries, which contains non-ionic surfactant, organic and/or inorganic builders, alkalinising agent and optionally bleaching agent, enzyme, polymer to inhibit greying and/or other conventional constituents and which is characterised in that it contains 5 wt. % to 30 wt. % of an ethoxylated alcohol corresponding to the general formula $R^1—(OC_2H_4)_m—OH$ (I), wherein $R^1$ denotes an alkyl or alkenyl group having 9 to 15 C atoms and the average degree of ethoxylation m can have values of 1 to 8, 1 wt. % to 20 wt. % of an ethoxylated alcohol corresponding to the general formula $R^2—(OC_2H_4)_n—OH$ (II), wherein $R^2$ denotes an alkyl or alkenyl group having 12 to 22 C atoms and the average degree of ethoxylation n can have values of 3 to 14 with the proviso that n is greater than m by at least 1.0, 20 wt. % to 80 wt. % alkalinising agent, in particular alkali metal silicate, 1 wt. % to 20 wt. % average- to long-chain alcohol or alkyl ether corresponding to the general formula $R^3—O—R^4$ (III), wherein $R^3$ denotes an alkyl or alkenyl group having 6 to 22 C atoms, in particular 8 to 22 C atoms and $R^4$ denotes hydrogen or an alkyl group having 1 to 6 C atoms, and up to 15 wt. % organic builder of the polymeric polycarboxylate type, polymeric polycarboxylate there meaning polymerisation products of unsaturated mono-and/or dicarboxylic acids having no other functional groups apart from carboxyl groups.

The agents disclosed in the above-mentioned documents have a high cleaning efficiency and are very suitable for the commercial washing of soiled laundry.

In all the above cases, specific demands are placed on the non-ionic surfactants as regards their solidification point and their composition. If the waste water and/or a part of the detergent solution accumulating after the washing process has been carried out is treated by membrane filtration, many non-ionic surfactants cause not inconsiderable problems. Depending on the choice of non-ionic surfactant, this may even lead to blocking-up of the membranes. This point is to be deemed particularly critical in membrane filtration processes in the course of which at least one reverse osmosis step occurs. The problem of the blocking-up of membranes during the filtration of waste water arising from washing processes is also dealt with in DE 197 26 287. This document provides a process for washing laundry, in particular clothing worn at work, in which the laundry is washed in a conventional type of washing machine for commercial laundries, using a combination of products comprising at least two components (A) an alkaline detergent component, containing
  (A1) anionic surfactant and water-soluble silicate and/or
  (A2) alkali hydroxide as well as
  (A3) complexing agent, and
(B) a surfactant component, containing preferably non-ionic surfactant, and the waste water is treated in a membrane filtration unit.

The above-mentioned document also provides a combination of products consisting of at least two components, for use in commercial laundries:

(A) an alkaline detergent component, containing
  (A1) anionic surfactant and water-soluble silicate and/or
  (A2) alkali hydroxide as well as
  (A3) complexing agent, and
(B) a surfactant component, containing preferably non-ionic surfactant.

Surprisingly, in such a procedure it was found that, as a result of using the above-mentioned combination of products and procedure, the flow rate through the membranes during the waste-water treatment is not only unimpaired, but in many cases can even be increased, that is, the combination of products appears to have a purifying effect on the membranes.

Moreover, this was irrespective of the membrane material, so that the procedure may be carried out with great advantage using in particular the common membranes based on polypropylene, ceramic and carbon.

Owing to the advantages of thixotropic paste-like agents and in order to complete the range of paste products used for cleaning, there existed a need to provide thixotropic pastes containing non-ionic surfactants which, owing to their composition, behave in an uninhibited manner during the subsequent treatment of the waste water by reverse osmosis. This need was all the more urgent, as the treatment of contaminated waste water and/or of a part of the detergent solution from corresponding washing processes in membrane filtration units, in particular by reverse osmosis, has become more important in recent years. In many cases it has even proved possible to return the treated water to the process again.

The present invention provides a hydrous, paste-like, thixotropic detergent or cleaning agent containing, based on the whole agent, a) an alkalinity support, selected from alkali hydroxide and/or alkali carbonate, in a quantity of 5 to 40 wt. %, preferably 8 to 30 wt. %, b) at least 5 wt. %, preferably 15 to 40 wt. % water, and c) more than 3 wt. %, preferably 5.5 to 30 wt. %, particularly preferably 6 to 15 wt. % non-ionic surfactants, wherein, at 25° C., the agent has a viscosity of 50,000 mPas to 250,000 mpas, measured using a Brookfield rotational viscometer (spindle no. 7) at 5 revolutions per minute and, under otherwise identical conditions, at 50 revolutions per minute has a viscosity of 12,000 mPas to 80,000 mPas and, if required, the viscosity can be adjusted by altering the proportion of water and/or liquid components and/or other aids to viscosity.

Preferably, in accordance with the formulation, no alkali metal silicate is added to the agent according to the invention.

In another preferred embodiment, the non-ionic surfactants present in the agent according to the invention include at least one compound corresponding to the general formula (I)

$$R^1—(OC_2H_4)_n—OH \quad (I)$$

wherein $R^1$ denotes a branched or unbranched alkyl or alkenyl group having 10 to 20 C atoms and the average degree of ethoxylation n has values of 5 to 20, preferably of 7 to 12, in particular of 7 to 10. It is particularly preferred that $R^1$ be a branched alkyl group having 10 to 16 C atoms.

DE 198 28 578 discloses creamy, highly alkaline, aqueous cleaning agents which, according to the statements commencing from line 65 in column 3, may contain weakly foaming surfactants, mainly non-ionic surfactants, in a quantity of up to 10 wt. %, preferably 1 to 5 wt. % and particularly preferably 2 to 4 wt. %. If the agents prepared in accordance with the above specification are used for the mechanical washing of laundry, a higher content of surfactant is advisable and may as a rule amount to 20 wt. %, preferably 0.1 to 15 wt. %, particularly preferably 1 to 10 wt. % and most preferably 2 to 4 wt. %, based on the whole agent. Besides non-ionic, cationic and amphoteric surfactants, one then uses in particular anionic surfactants selected from among the alkyl benzenesulfonates, the fatty alcohol sulfates, the fatty alcohol ether sulfates and other known anionic surfactants.

In contrast, the present invention provides substantially thixotropic agents which, in a preferred embodiment, exhibit very good membrane compatibility in the case of the membrane treatment of the waste water or of a part of the detergent solution from the washing process.

Furthermore, in a preferred embodiment the agents according to the invention contain sodium hydroxide and/or soda as alkalinity support.

The agents according to the invention preferably contain in addition up to 10 wt. %, preferably 0.5 wt. % to 8 wt. %, anionic surfactant, in particular $C_8$–$C_{18}$-alkyl sulfates, $C_8$–$C_{18}$-alkyl ether sulfates, $C_8$–$C_{18}$-alkane sulfonates, $C_8$–$C_{18}$-α-olefin sulfonates, sulfonated $C_8$–$C_{18}$ fatty acids, $C_8$–$C_{18}$-alkyl benzenesulfonates, sulfosuccinic mono- and di-$C_1$–$C_{12}$-alkyl esters, $C_8$–$C_{18}$-alkyl polyglycol ether carboxylates, $C_8$–$C_{18}$-N-acyl taurides, $C_8$–$C_{18}$-N-sarcosinates, $C_8$–$C_{18}$-alkyl isethionates as well as mixtures of the above.

It is likewise preferred that the agents according to the invention contain in addition at least one alkyl polyglucoside having 8 to 14 C atoms in the alkyl group and 1 to 5 glucose units, particularly preferably in a proportion of 0.1 to 5 wt. %, based on the whole agent.

It is through the addition of alkyl polyglucoside in particular that agents having the properties according to the invention are obtained.

In another preferred embodiment, the agents according to the invention contain in addition a complexing agent selected from polyphosphonic acids, in particular 1-hydroxyethane-1,1-diphosphonic acid, diethylenetriaminepentamethylenephosphonic acid, ethylenediaminetetramethylenephosphonic acid, N-(2-hydroxyethyl)-N,N-bismethylenephosphonic acid and their salts and/or polycarboxylic acids, in particular copolymers of acrylic acid and maleic acid and of their salts, or NTA or organic acids, preferably citric acid, and their salts, in particular in a proportion of 1 to 20 wt. %, based on the whole agent.

It is also preferred that the agents according to the invention, based on the whole agent, contain in addition 0.5 to 10 wt. % branched or unbranched $C_{8-22}$ fatty alcohol. $C_{8-14}$ fatty alcohols, in particular those having a branched alkyl group, are most particularly preferred.

It is also preferred that the agents according to the invention contain in addition a phosphate, preferably tripolyphosphate, particularly preferably in a concentration of 5 to 50 wt. %, based on the whole agent. Besides the above-mentioned ingredients, the agent according to the invention may contain additives conventionally used in such alkaline detergent compositions, such as cobuilders, optical brighteners, dyes and aromas, small quantities of neutral salts such as sulfates and chlorides in the form of their sodium or potassium salts, provided that these do not impair the positive properties. Other suitable additives to the product may be enzymes, bleaching agents from the class of per compounds, which are conventionally used together with activators, active chlorine compounds as well as dyes and aromas. In the case of additives which have an oxidising action, it is advisable to test the compatibility with corresponding reverse osmosis membranes, if the latter take part in the overall process.

The present invention also provides a mechanical washing process with process-controlled metering of the quantities of detergent and water, wherein a detergent or cleaning agent according to the invention is fed into the detergent compartment of a washing machine by means of a process-controlled device for metering the agent and it is preferred that the waste water and/or a part of the detergent solution accumulating during the process be treated in a membrane filtration unit and particularly preferably at least one reverse osmosis step is undergone during the membrane filtration.

EXAMPLES

In support of the present invention, firstly the influence of paste-like, thixotropic detergents or cleaning agents on the performance of reverse osmosis membranes was investigated. Secondly, measurements were taken in order to examine the thixotropic properties of a paste according to the invention.

The formulations used in the Examples are given in Table 1.

TABLE 1

| Formulations used in Examples and Comparison Examples | Pastes in Examples (1) | (2) | (3) | Comparison paste |
|---|---|---|---|---|
| NaOH | 18 | 18 | 18 | - |
| Distilled water | 25 | 25 | 25 | - |
| Branched $C_{12}$-fatty alcohol | 3 | 3 | 3 | 3 |
| Alkyl benzenesulfonate | 1 | 1 | 1 | 1 |
| Optical brightener | 0.5 | 0.5 | 0.5 | 0.5 |
| Phosphonate (Turpinal 2NZ) | 3.5 | 3.5 | 3.5 | 2 |
| Polymaleic acrylic acid, Na | 6 | 6 | 6 | 6 |
| Na tripolyphosphate | 27 | 10 | - | - |
| Branched nio-surfactant with 13 C and 8 EO | 9 | 9 | 9 | - |
| Dehydrol LS3/LT7 | - | - | - | 30 |
| Na citrate dihydrate | 5.5 | 10 | 11 | - |
| Soda | - | 12 | 21 | 22 |
| $C_8$-$C_{14}$-alkyl polyglucoside | 1.5 | 2 | 2 | - |
| Na metasilicate | - | - | - | 35.5 |

In order to assess the influence on the reverse osmosis membranes, various precautions were taken. The waste-water flow to be treated was diverted from the waste-water flow of a continuously operating machine for washing textiles in a pilot laundry. The washing process in the pilot laundry differed in the various test stages only in the different products used: the pastes in Examples 1 to 3 and the comparison paste. Each of the above-mentioned products was used in the respective washing process in 2% concentration.

The waste-water flow being treated was passed through a 75μ-prefilter. The reverse osmosis membrane used had a surface area of 40 qm and a capacity of 15 l per $m^2$.h. The reverse osmosis membrane used was made of an organic material (polypropylene). The temperature during the reverse osmosis was about 40° C. The reverse osmosis was carried out in such a way that about 80% of the waste-water flow being treated was obtained as reusable permeate and about 20% of the waste-water flow being treated was obtained as concentrate having a high salt content and a high organic load, which is discarded.

The duration of the test stages with the four products being investigated amounted in each case to 5 days with 8 hours' operating time per day. The reverse osmosis membrane was thoroughly cleaned prior to each change of product. This measure ensured that the initial performance $X_A$, expressed in the form of the flow rate [l/h], was about the same in all the tests. The reverse osmosis membrane was washed thoroughly with water daily after the end of the operation, within the test period.

On conclusion of the respective test stage, the final performance $X_E$ was determined in the form of the flow rate [l/h]. The ratio of $X_E$ to $X_A$ was used in order to characterise each of the products examined in the test stages. The ratio $X_E$:$X_A$ can be used as an indication as to whether, under otherwise identical conditions, a cleaning of the reverse osmosis membrane is necessary at shorter or longer intervals.

For further characterisation, on conclusion of each test stage a standard cleaning was carried out, in accordance with the recommendations of the manufacturers of cleaning products for reverse osmosis membranes. At the end of the cleaning procedure, the "final performance after cleaning" $X_{ER}$ was determined in the form of the flow rate [l/h]. The ratio $X_{ER}$:$X_A$ was then calculated as a characteristic value. The ratio $X_{ER}$:$X_A$ can be taken as an indication of the extent to which the reverse osmosis membrane is regenerable after a given running time with a given product concept.

Depending on how badly or well the reverse osmosis membrane can be regenerated, sooner or later new reverse osmosis membranes have to be purchased at great cost. The ratios $X_E$:$X_A$ and $X_{ER}$:$X_A$ obtained on using the pastes in the three Examples and the comparison paste can be seen in Table 2. These values confirm that the pastes according to the invention have advantages as regards use in processes in which the waste water is filtered through reverse osmosis membranes.

TABLE 2

Performance of the reverse osmosis membrane during the treatment of waste water from washing processes in which various detergent pastes were used.

| Paste | Performance during reverse osmosis $X_E$:$X_A$ | $X_{ER}$:$X_A$ |
|---|---|---|
| Paste in Example 1 | 0.48 | 0.75 |
| Paste in Example 2 | 0.69 | 0.63 |
| Paste in Example 3 | 0.82 | 0.94 |
| Comparison paste 4 | 0.33 | 0.40 |

In addition to the effect on the reverse osmosis process, the thixotropic properties of a paste according to the invention were also verified by experiment. For this, the formulation of the paste in Example 3 was investigated at 20° C. and continuously varying shear rates. The resulting viscosities after various times and shear rates are listed in Table 3.

TABLE 3

Continuous measurement of the viscosity of the paste in Example 3 during increasing and decreasing shear rates

| Time + [s] | Shear rate γ [1/3] | Viscosity n [Pas] | n [mPas] |
|---|---|---|---|
| 20 | 0.1 | 3804 | 3804000 |
| 40 | 1 | 678 | 678000 |
| 60 | 10 | 91 | 91000 |
| 80 | 100 | 1 | 1000 |
| 100 | 114.1 | 0.15 | 150 |
| 120 | 100 | 0.08 | 80 |
| 140 | 10 | 0.32 | 320 |
| 160 | 1 | 1.5 | 1500 |
| 180 | 0.1 | 7 | 7000 |

It is clear from the Table that the pastes according to the present invention have thixotropic properties. With a longer relaxation time or resting position of the paste, the viscosity again comes closer to the starting point.

TABLE 4

Investigation of the viscosities of the pastes in Examples 1 to 3 using a Brookfield rotational viscometer (spindle no. 7) at varying speed

| Examples | Viscosity [mPas] | |
|---|---|---|
| | 5 revolutions per mm. | 50 revolutions per mm. |
| 1 | 185,000 | 68,000 |
| 2 | 150,000 | 55,000 |
| 3 | 145,000 | 42,000 |

The invention claim is:

1. A water-containing, thixotropic, cleaning paste comprising:

a. about 5 to about 40 wt. % of a source of alkalinity, wherein the source of alkalinity is selected from the group consisting of an alkali metal hydroxide and an alkali metal carbonate;

b. at least about 15 wt. % of water; and c. at least about 3 wt. % of a nonionic surfactant, wherein the nonionic surfactant has the general formula $$R^1—(OC_2H_4)_n—OH$$

where $R^1$ is a $C_{10}$–$C_{20}$ branched or unbranched alkyl or alkenyl group n is the average degree of ethoxylation and has a value from 5 to 20;

wherein the composition has a viscosity at 25° C. from 50,000 mPas to 250,000 mPas as measured with a Brookfield rotational viscosimeter having a spindle number 7 at 5 r.p.m.

2. The composition of claim 1, further comprising additional nonionic surfactants.

3. The composition of claim 1, wherein the source of alkalinity is present from about 8 to about 30 wt. %.

4. The composition of claim 1, wherein the water is present from about 15 to about 40 wt. %.

5. The composition of claim 1, wherein the nonionic surfactant is present from about 5.5 to about 30 wt. %.

6. The composition of claim 1, wherein the nonionic surfactant is present from about 6 to about 15 wt. %.

7. The composition of claim 1, wherein the composition is free from alkali metal silicate.

8. The composition of claim 1, wherein n has a value from 7 to 12.

9. The composition of claim 1, wherein n has a value from 7 to 10.

10. The composition of claim 1, wherein the source of alkalinity is sodium hydroxide.

11. The composition of claim 1, further comprising an anionic surfactant.

12. The composition of claim 11, wherein the anionic surfactant is selected from the group consisting of $C_{8–18}$ alkyl sulfates, $C_{8-18}$ alkyl ether sulfates, $C_{8-18}$ alkane sulfonates, $C_{8-18}$ α-olefin sulfonates, sulfonated $C_{8–18}$ fatty acids, $C_{8-18}$ alkyl benzensulfoantes, sulfosuccinic acid mono- and di-$C_{1-12}$-alkyl esters, $C_{8-18}$ alkyl polyglycolether carbonates, $C_{8-18}$ N-acyltaurides, $C_{8-18}$ N-sarcosinates, $C_{8-18}$ alkyl isethionates, and mixtures thereof.

13. The composition of claim 11, wherein the anionic surfactant is present at up to about 10 wt. %.

14. The composition of claim 11, wherein the anionic surfactant is present from about 0.5 to about 8 wt. %.

15. The composition of claim 1, further comprising at least one $C_8$ to $C_{14}$ alkyl polyglucoside having from 1 to 5 glucose units.

16. The composition of claim 1, further comprising a complexing agent, wherein the complexing agent is selected from the group consisting of polyphosphonic acid, polycarboxylic acid, and mixtures thereof.

17. The composition of claim 16, wherein the polyphosphonic acid is selected from the group consisting of 1-hydroxyethane-1,1-diphosphonic acid, diethylenetriamine pentamethylene phosphonic acid, ethylenediamine tetramethylene phosphonic acid, N-(2-hydroxyethyl)-N,N-bis-methylenephosphonic acid, and salts thereof.

18. The composition of claim 16, wherein the polycarboxylic acid is selected from the group consisting of copolymers of acrylic acid, copolymers of maleic acid, and salts thereof.

19. The composition of claim 1, further comprising from about 0.5 to about 10 wt. % of a $C_8$ to $C_{22}$ fatty alcohol, wherein the fatty alcohol is branched or unbranched.

20. The composition of claim 1, further comprising a phosphate.

21. The composition of claim 20, wherein the phosphate is a tripolyphosphate.

22. A method of dispensing a composition comprising:

a. providing a thixotropic, cleaning paste comprising:

i. about 5 to about 40 wt. % of a source of alkalinity, wherein the source of alkalinity is selected from the group consisting of an alkali metal hydroxide and an alkali metal carbonate;

ii. at least about 15 wt. % of water; and iii. at least about 3 wt. % of a nonionic surfactant, wherein the nonionic surfactant has the general formula $$R^1—(OC_2H_4)_n—OH$$

where $R^1$ is a C10–C20 branched or unbranched alkyl or alkenyl group n is the average degree of ethoxylation and has a value from 5 to 20;

wherein the composition has a viscosity at 25° C. from 50,000 mPas to 250,000 mPas as measured with a Brookfield rotational viscosimeter having a spindle number 7 at 5 r.p.m;

b. dispensing the composition into the liquor tank of a washing machine by a process-controlled device;

c. mixing the composition with water.

23. The method of claim 22, further comprising the steps of:

d. forming wastewater from the composition and water; and e. treating the wastewater with a membrane filtration unit.

24. The method of claim 23, wherein the treating the wastewater with a membrane filtration unit includes using reverse osmosis.

* * * * *